US006135822A

United States Patent [19]

Hwang

[11] Patent Number: 6,135,822

[45] Date of Patent: Oct. 24, 2000

[54] PORT ARRANGEMENT OF MULTI-PORT CONNECTOR SYSTEM

[75] Inventor: Jeng-Yih Hwang, Irvine, Calif.

[73] Assignee: Hon Hai Precision Ind. Co., Ltd., Taipei Hsien, Taiwan

[21] Appl. No.: 09/368,636

[22] Filed: Aug. 4, 1999

[51] Int. Cl.[7] ..... H01R 13/64

[52] U.S. Cl. ..... 439/680

[58] Field of Search ..... 439/680, 681, 439/677, 682, 692

[56] References Cited

U.S. PATENT DOCUMENTS 4,544,220 10/1985 Aiello et al. .

5,133,672 7/1992 Nelligan, Jr. et al. ..... 439/399

5,257,948 11/1993 Peterson ..... 49/571

5,342,221 8/1994 Peterson ..... 439/677

*Primary Examiner*—Gary F. Paumen

*Attorney, Agent, or Firm*—Wei Te Chung

[57] ABSTRACT

A port arrangement of a multi-port connector includes a plurality of ports arranged in a matrix having at least two rows and more than two columns. The matrix has four corner ports and remaining central ports. The corner ports are formed to be rectangular or square, while the central ports are chamfered at two adjacent corners. The corner ports prevent misalignment caused by relative translation between two mating connectors, while the central ports prevent misalignment caused by relative rotation between the connectors.

14 Claims, 4 Drawing Sheets

PORT ARRANGEMENT OF MULTI-PORT CONNECTOR SYSTEM

BACKGROUND OF THE INVENTION

1. Field of the Invention

The present invention generally relates to an arrangement of ports of a multi-port connector system, and in particular to a port arrangement of a multi-port connector system for preventing misalignment thereof with a mating connector.

2. The Prior Art

Electrical connectors having multiple ports are commonly used in both power and signal applications for carrying high currents. Conventional multi-port connectors, such as those disclosed in U.S. Pat. Nos. 5,342,221, 4,544,220, 5,133,672, and 5,257,948, comprise a number of ports arranged in at least one row. Posts, each forming a port, are formed in a male connector, while corresponding receiving holes are defined in a mating female connector. The posts of the male connector are arranged to prevent misalignment with the counterpart receiving holes of the female connector by chamfering at least some of the posts. Some of chamfered posts are one corner chamfered, while the others are two corner chamfered. Conventionally, the posts are arranged in a complicated way for preventing misalignment with the mating connector. However, the complicated arrangement of the posts hinders expansion of the number of the ports.

It is thus desired to provide a port arrangement for multi-port connectors to overcome the problem discussed above.

SUMMARY OF THE INVENTION

Accordingly, an object of the present invention is to provide a simplified port arrangement of a multi-port connector.

Another object of the present invention is to provide a port arrangement of a multi-port connector allowing ready expansion of the number of ports of the connector.

A further object of the present invention is to provide a port arrangement of a multi-port connector which effectively eliminates misalignment of mating connectors.

To achieve the above objects, a port arrangement of a multi-port connector in accordance with the present invention comprises a plurality of ports arranged in a matrix having at least two rows and more than two columns. The matrix has four corner ports and remaining central ports. The corner ports are formed to be rectangular or square, while the central ports are chamfered at two adjacent corners. The corner ports prevent misalignment caused by relative translation between two mating connectors, while the central ports prevent misalignment caused by relative rotation between the connectors.

BRIEF DESCRIPTION OF THE DRAWINGS

The present invention will be apparent to those skilled in the art by reading the following description of a preferred embodiment thereof, with reference to the accompanying drawings, in which.

DETAILED DESCRIPTION OF THE PREFERRED EMBODIMENT

Figure 1:
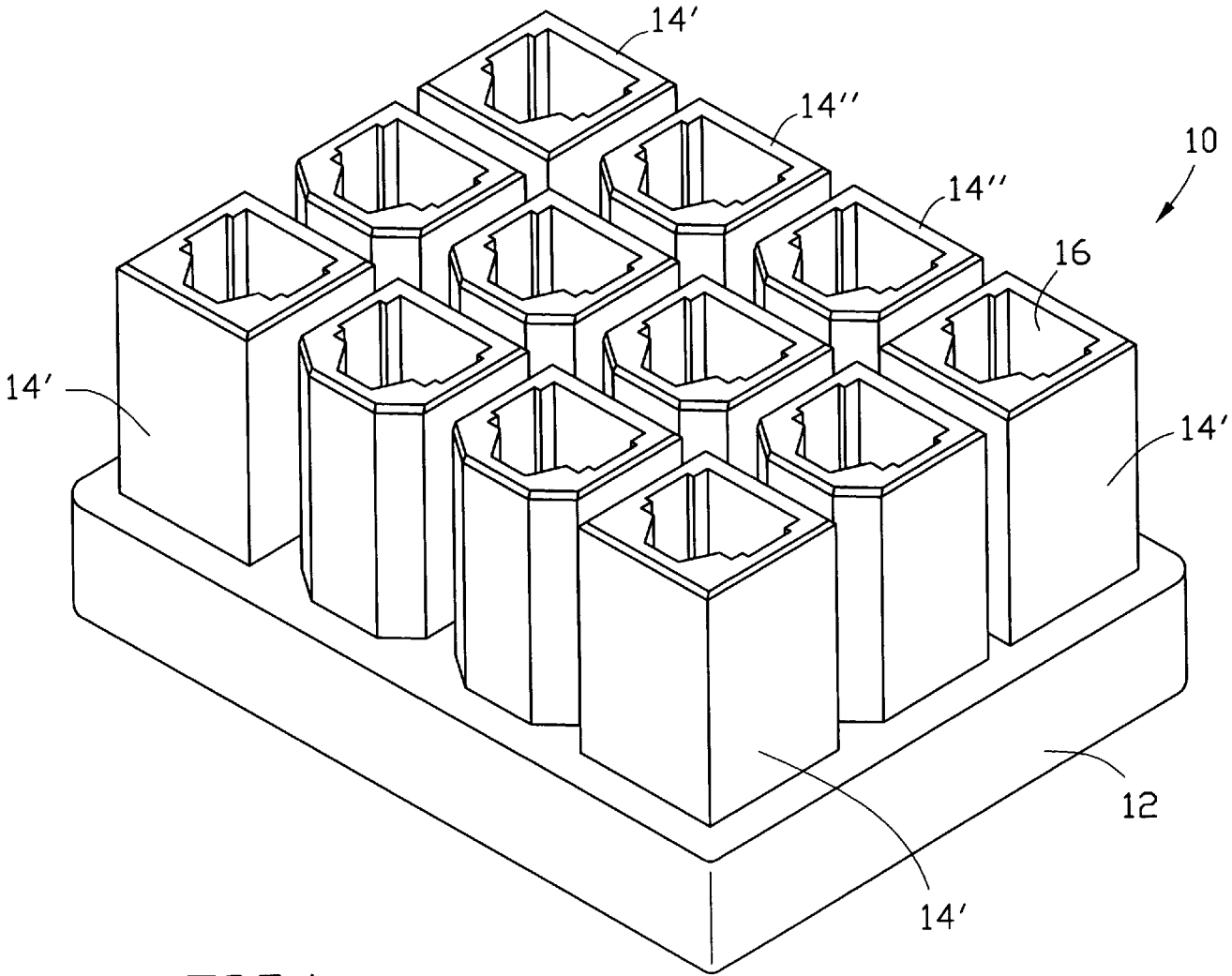
FIG. 1 is a perspective view of a multi-port male connector constructed in accordance with the present invention.
Figure 3:
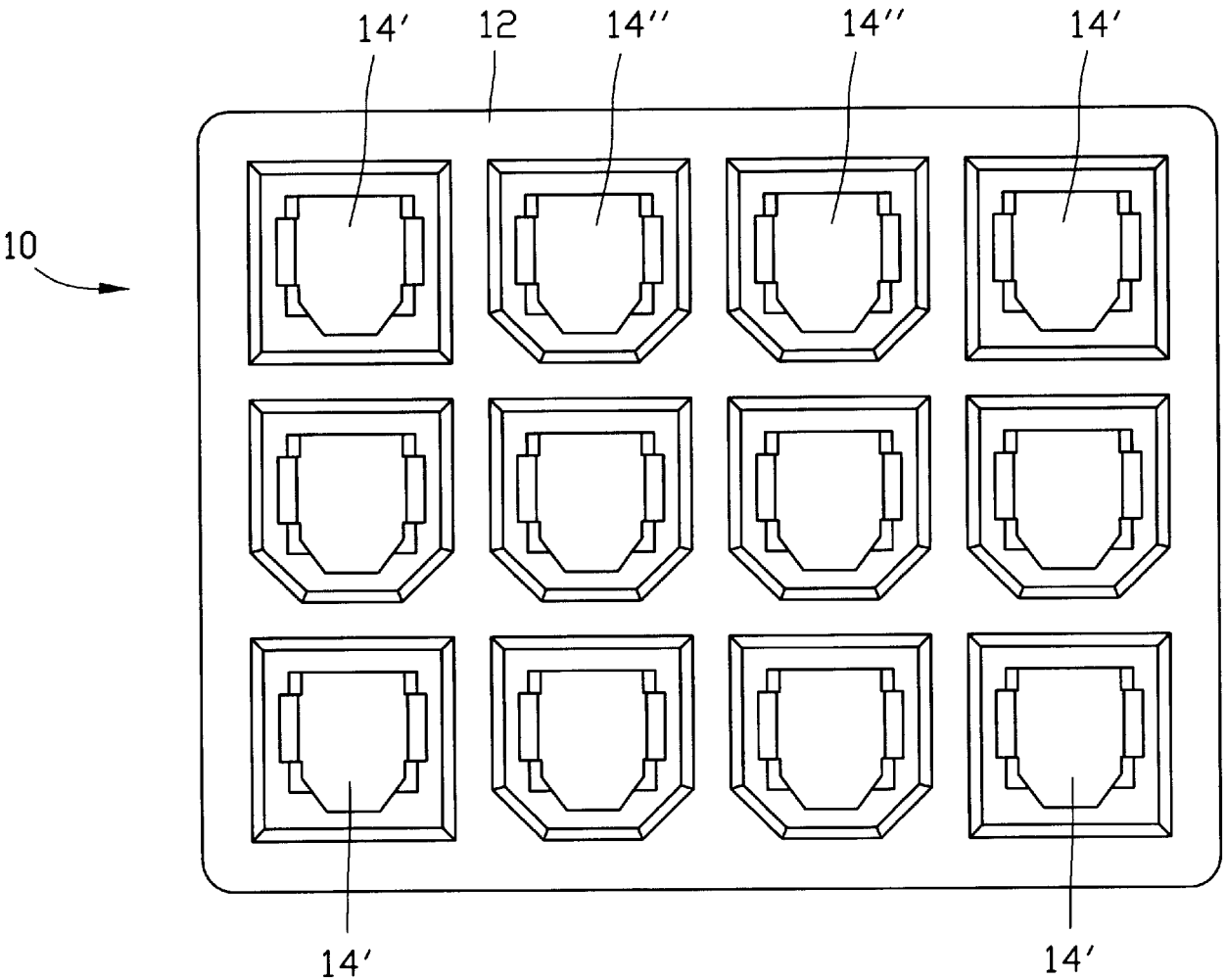
FIG. 3 is a plan view of the male connector.

Referring to the drawings and in particular to FIGS. 1 and 3, a multi-port male connector 10 constructed in accordance with the present invention comprises a base 12 on which a plurality of posts 14', 14" are formed and spaced from each other. Each post 14', 14" forms a port in which a bore 16 is defined for receiving and retaining a first contact (not shown). The posts 14', 14" are arranged in a matrix having at least two rows and more than two columns. In the embodiment illustrated, the matrix has three rows and four columns.

The matrix has four corner posts 14' and the remaining central posts 14". In accordance with the present invention, the corner posts 14' are quadrilateral, such as square or rectangular, while the central posts 14" are chamfered at one or more corners. Although, as shown in the drawings, each central post 14" has a shape symmetric about a bisecting plane thereof, the shape of the central post 14" is by no means symmetric about a central axis thereof. Preferably, as shown in the drawings, each central post 14" is chamfered at two adjacent corners thereof. The non-chamfered corner posts 14' prevent misalignment caused by relative translation in directions parallel to the rows and columns of the posts, while the chamfered central posts 14" prevent a misalignment caused by relative rotation with respect to the mating connector.

Figure 2:
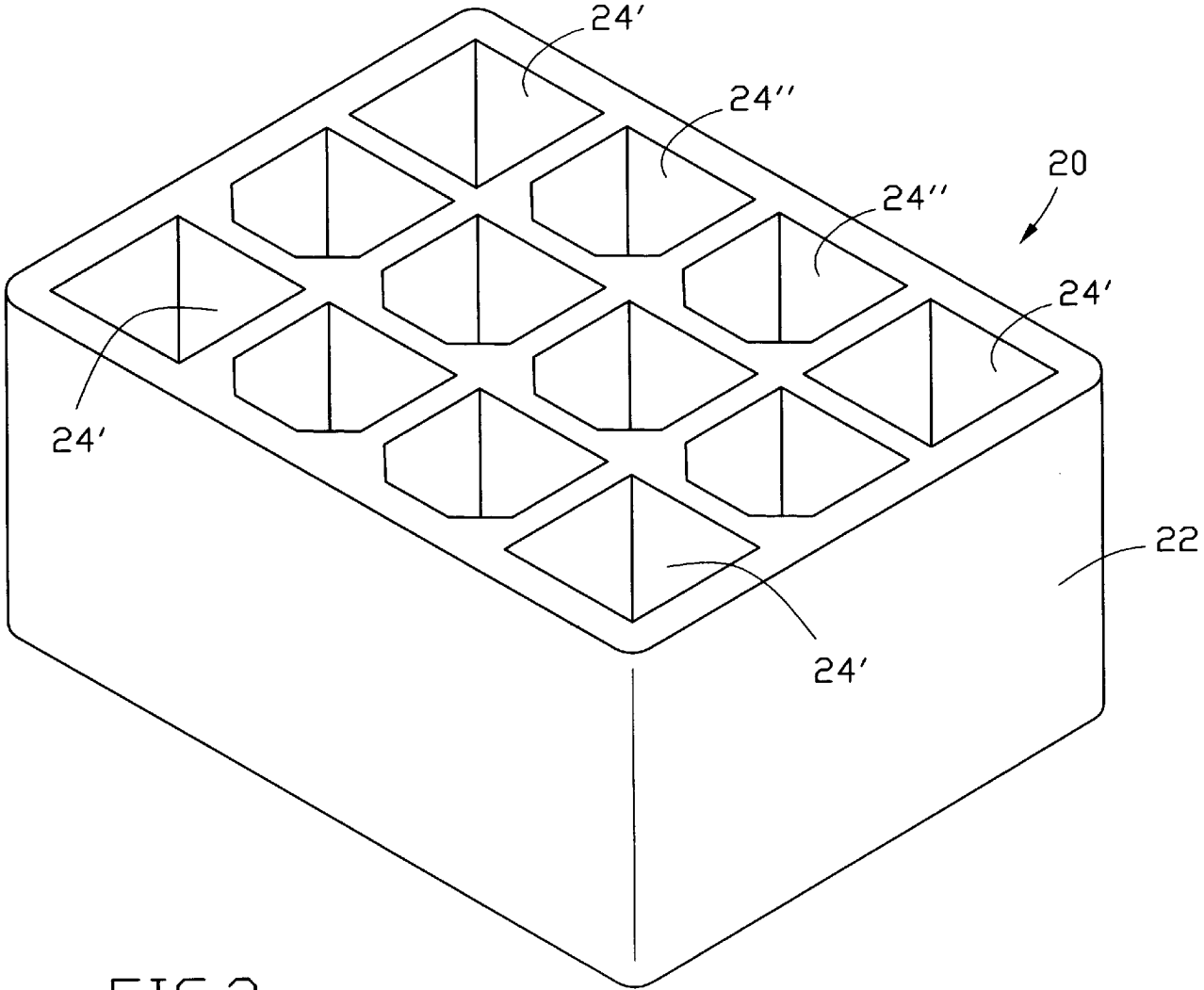
FIG. 2 is a perspective view of a multi-port female connector in accordance with the present invention.
Figure 4:
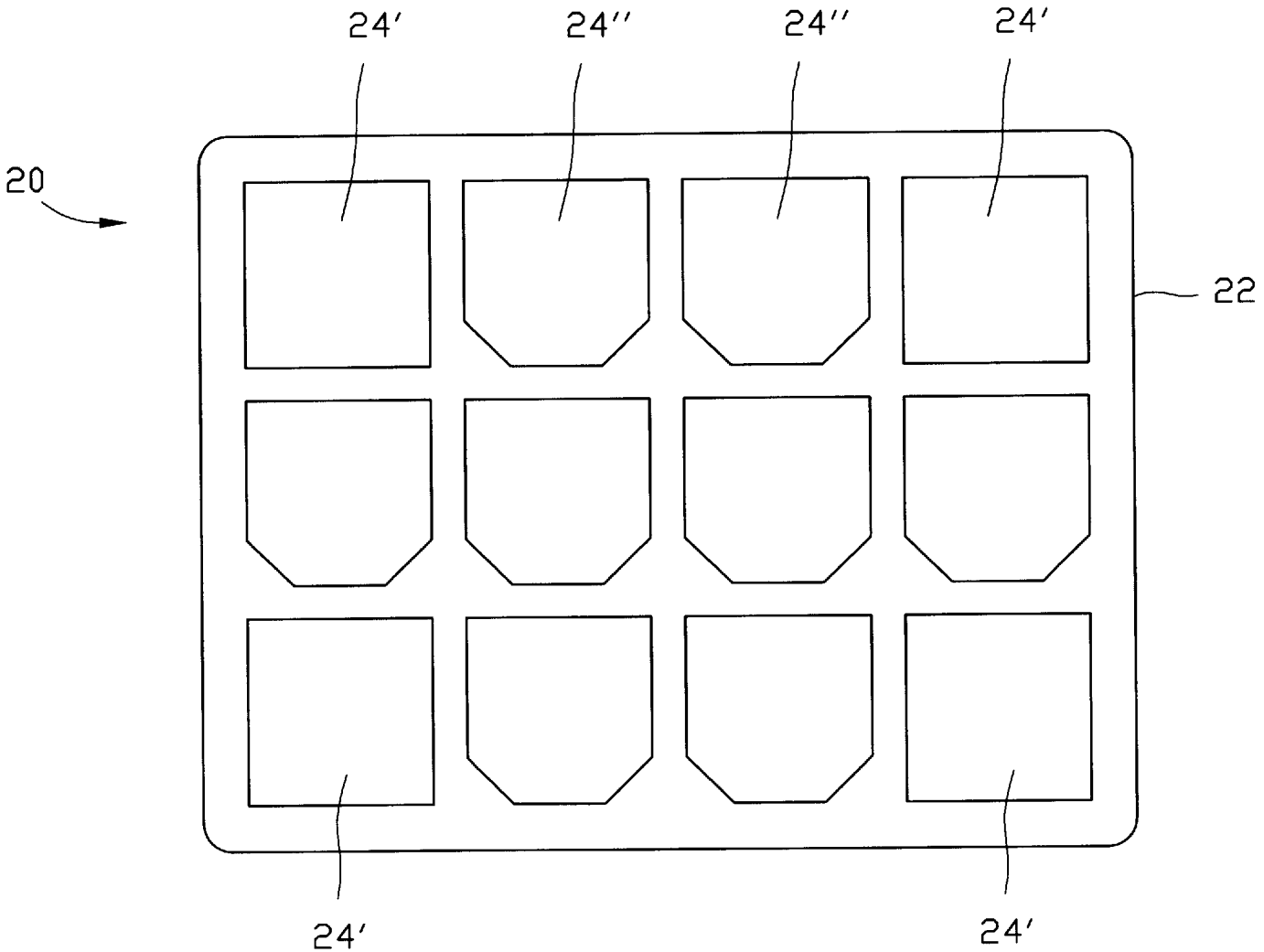
FIG. 4 is a plan view of the female connector.

Referring to FIGS. 2 and 4, a multi-port female connector 20 in accordance with the present invention is mateable with the male connector 10 and comprises a casing 22 defining a plurality of receiving holes 24', 24" each receiving and retaining a second contact (not shown) for engaging with the corresponding first contact of the male connector 10. The receiving holes 24', 24" are arranged in a matrix having rows and columns corresponding to the posts 14', 14" of the male connector 10. The receiving holes 24', 24" include four corner holes 24' and the remaining central holes 24". The corner holes 24' are quadrilateral corresponding to the corner posts 14' of the male connector 10, while the central holes 24" are shaped corresponding to the chamfered central posts 14" of the male connector 10 whereby the posts 14', 14" of the male connector 10 are insertable into the corresponding holes 24', 24" of the female connector 20 to engage the first and second contacts with each other.

To summarize, the ports 14', 14", 24', 24" of the multi-port connectors 10, 20 of the present invention are arranged in a matrix having four corner ports 14', 24" which are quadrilateral, while the remaining ports (the central ports) 14", 24" are chamfered. Preferably, the central ports 14", 24" are chamfered at two adjacent corners and all the central ports 14", 24" are identical. However, the central ports 14", 24" may be chamfered at only one corner or more than two corners. The non-chamfered corner ports 14', 24' prevent misalignment caused by relative translation parallel to the rows and columns thereof, while the chamfered ports 14", 24" prevent misalignment caused by relative rotation between the connectors 10, 20. Such an arrangement is readily applicable to multi-port connectors having more rows and columns by simply forming the corner ports with a quadrilateral shape, while the remaining central ports are identically chamfered. Understandably, the connector can be configured in an opposite way to have the corner ports chamfered and leave the central ports rectangular. Moreover, the spirit of the invention is to provide first and second groups of ports respectively with two different outline shapes for both the male connector and the female connector wherein four corner ports belong to the first group and the remaining central ports belong to the second group, and wherein the first group of ports of the male connector may snugly mate snugly mate with the corresponding first group of ports of the female connector, and the second group of ports of the male connector may snugly mate with the corresponding second group of ports of the female connector. As mentioned before, the reason for distinguishing these two groups from each other is to prevent misalignment caused by linear deviation between the two mating connectors, and additionally, at least one group of ports include some structure which provides polarization function, i.e., chamfers, for preventing misalignment caused by rotative deviation between the two mating connectors.

Although the present invention has been described with reference to the preferred embodiment, it is apparent to those skilled in the art that a variety of modifications and changes may be made without departing from the scope of the present invention which is intended to be defined by the appended claims.

What is claimed is:

1. A port arrangement of a multi-port connector comprising a plurality of ports arranged in a matrix having at least two rows and more than two columns, the matrix having four corner ports and remaining central ports, the central ports being formed in a quadrilateral shape, and each central port being chamfered, the corner ports being unchamfered.

2. The port arrangement as claimed in claim 1, wherein the central ports are chamfered at two adjacent corners thereof.

3. The port arrangement as claimed in claim 1, wherein the corner ports are rectangular.

4. The port arrangement as claimed in claim 3, wherein the corner ports are square.

5. A connection system comprising:

a male connector comprising a base on which a plurality of spaced posts are formed, each defining a bore for receiving and retaining a first contact, the posts being arranged in a matrix having at least two rows and more than two columns, the matrix having four corner posts and remaining central posts, each corner post being quadrilateral and unchamfered and each central post being chamfered; and a female connector comprising a casing defining a plurality of receiving holes for receiving and retaining a second contact therein, the receiving holes being arranged in a matrix corresponding to the matrix of the posts and shaped corresponding to the corresponding posts for receiving the posts therein to engage the first and second contacts with each other.

6. The connection system as claimed in claim 5, wherein the matrix has three rows and four columns.

7. The connection system as claimed in claim 5, wherein the central posts are chamfered at two adjacent corners thereof.

8. The connection system as claimed in claim 5, wherein the corner posts are rectangular.

9. The connection system as claimed in claim 8, wherein corner posts are square.

10. A method for arranging ports of a multi-port connector to prevent misalignment with a mating connector comprising the following steps:

(a) arranging the ports of the connector in a matrix having at least two rows and more than two columns whereby the matrix includes four corner ports and the remaining central ports;

(b) forming the corner ports with a quadrilateral shape; and (c) chamfering the central ports while leaving the corner ports unchamfered.

11. The method as claimed in claim 10, wherein the matrix has three rows and four columns.

12. The method as claimed in claim 10, wherein the central ports are chamfered at two adjacent corners thereof.

13. The method as claimed in claim 10, wherein the corner ports are rectangular.

14. The method as claimed in claim 13, wherein the corner ports are square.

* * * * *